US010226653B2

(12) United States Patent
Reda et al.

(10) Patent No.: US 10,226,653 B2
(45) Date of Patent: Mar. 12, 2019

(54) FIRE SUPPRESSION AND CONTAINMENT DEVICE

(71) Applicant: First Cousins, LLC, Yonkers, NY (US)

(72) Inventors: Frank R. Reda, Yonkers, NY (US); Frank P. Bevilacqua, Norwalk, CT (US)

(73) Assignee: First Cousins, LLCF, Yonkers, NY (US)

( * ) Notice: Subject to any disclaimer, the term of this patent is extended or adjusted under 35 U.S.C. 154(b) by 0 days.

(21) Appl. No.: 14/681,010

(22) Filed: Apr. 7, 2015

(65) Prior Publication Data

US 2016/0296776 A1 Oct. 13, 2016

(51) Int. Cl.
*A62C 3/02* (2006.01)

(52) U.S. Cl.
CPC ..... *A62C 3/0292* (2013.01); *A62C 3/0257* (2013.01)

(58) Field of Classification Search
CPC ..... A62C 3/0292; A62C 3/0257
USPC ..... 169/54; 404/6
See application file for complete search history.

(56) References Cited

U.S. PATENT DOCUMENTS 3,877,526 A * 4/1975 Dolbeer ..... A62C 3/0292 169/16
3,933,311 A * 1/1976 Lemelson ..... B05B 1/18 239/276
4,681,302 A * 7/1987 Thompson ..... E01F 8/0035 256/13.1
4,945,675 A * 8/1990 Kendrick ..... A01G 1/08 239/201
6,021,599 A * 2/2000 Matz ..... A01G 1/08 239/276
6,068,083 A * 5/2000 Takahashi ..... E06C 7/08 182/90
6,341,445 B1 * 1/2002 Morrison ..... A01G 1/08 47/33

FOREIGN PATENT DOCUMENTS

CN 104372755 A * 2/2015

* cited by examiner

*Primary Examiner* — Jason J Boeckmann
(74) *Attorney, Agent, or Firm* — Ferdinand IP, LLC

(57) ABSTRACT

A device configured for fire suppression and containment.

34 Claims, 7 Drawing Sheets

FIRE SUPPRESSION AND CONTAINMENT DEVICE

COPYRIGHT NOTICE

A portion of the disclosure of this patent document contains material that is subject to copyright protection. The copyright owner has no objection to the facsimile reproduction by anyone of the patent document or the patent disclosure as it appears in the Patent and Trademark Office patent files or records, but otherwise reserves all copyrights whatsoever.

FIELD OF RELATED ART

Described are embodiments for containing and combating fires.

DESCRIPTION OF RELATED ART

Forest fires typically occur during periods of drought caused by extended periods of lack of rain and have the potential to devastate hundreds of thousands, of acres of land. A current method of attempting to stop such fires is to drop volumes of water and other fire retardant substances from airplanes and helicopters onto existing fires and employing on-the-ground firefighters. Unfortunately, these methods can prove ineffective, and too frequently result in the loss of life as well as the destruction of thousands of acres of land and extensive property damage.

SUMMARY

According to embodiments, disclosed is a device comprising: a fire resistant wall, the wall comprising an inlet for receiving fire suppressant fluid a chamber connected to the inlet and configured to keep the fluid under pressure; and a dispenser connected to the chamber and configured to dispense the fluid through the wall. Any of the embodiments of the wall can comprise materials selected from the group of concrete, titanium, stainless steel, heavy gauge aluminum, and galvanized steel. In embodiments, the wall can be portable. The wall can comprise a fastener for connecting to an adjacent wall. The wall can comprise one or more openings at a base of the wall and extending through the wall. The opening can be configured to allow wildlife to pass through the wall. The opening can be configured to allow drainage to pass through the wall. The wall can include footholds to facilitate a person's movement over the wall.

In embodiments the device can comprise a plurality of the walls. In embodiments the walls can be connected in series.

In embodiments the wall can be configured as a single wall. In embodiments the wall can be configured to be used alone or with one or more other walls.

In embodiments the chamber can comprise a main artery, and one or more angled channels extending from the main artery to one or more corresponding apertures on a face of the wall. In embodiments the chamber can be configured to be operatively connected to a chamber of an adjacent wall such that fluid can flow through a plurality of the walls when the walls are connected.

In embodiments the device can comprise a plurality of the walls connected in series, and can include a main artery that extends through a plurality of the respective chambers of the plurality of the walls. The device can include a plurality of the walls connected in series by at least one connector connecting respective chambers for each of the plurality of walls. The connector can include a valve. The chamber can be configured to hold the fluid under pressure.

BRIEF DESCRIPTION OF THE DRAWINGS

Embodiments are illustrated in the figures of the accompanying drawings, which are meant to be exemplary and not limiting, and in which like references are intended to refer to like or corresponding things.

DETAILED DESCRIPTION OF THE EMBODIMENTS

Figure 1A:
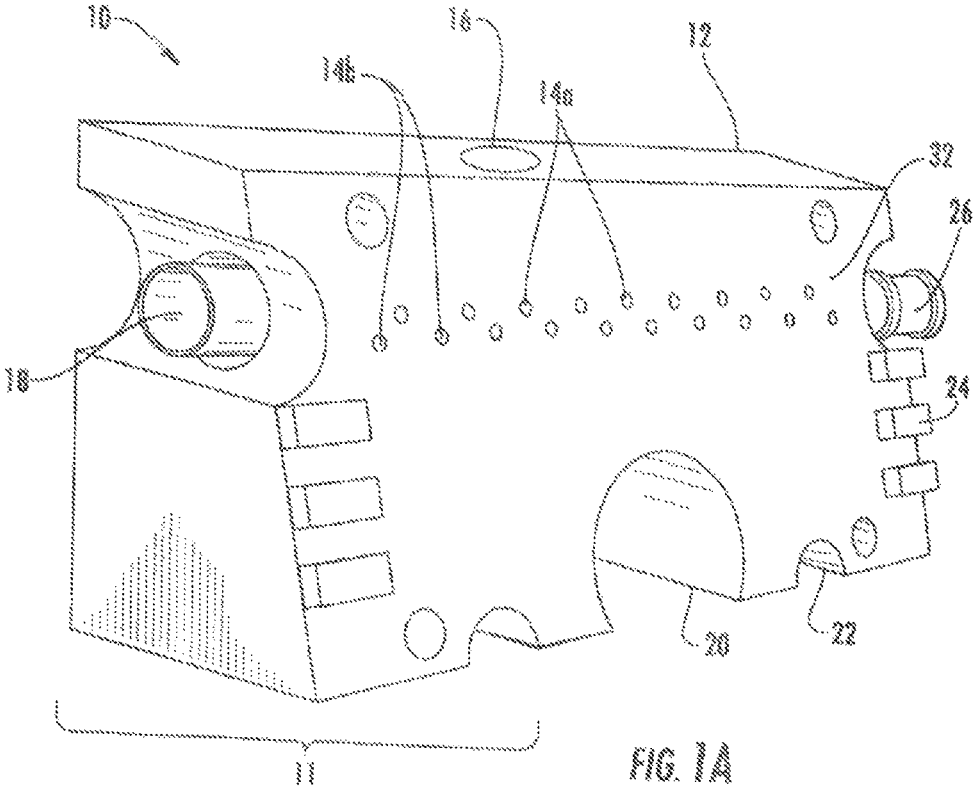
FIG. 1A is a perspective view of an embodiment of the device.

Referring to the drawings, FIG. 1A shows an embodiment of a fire containment and suppression device 10. An embodiment of the device 10 can comprise one or more fire resistant walls 12. The device 10 includes a dispenser 32 configured to dispense fire suppressant fluid or material through the wall 12.

Figure 2:
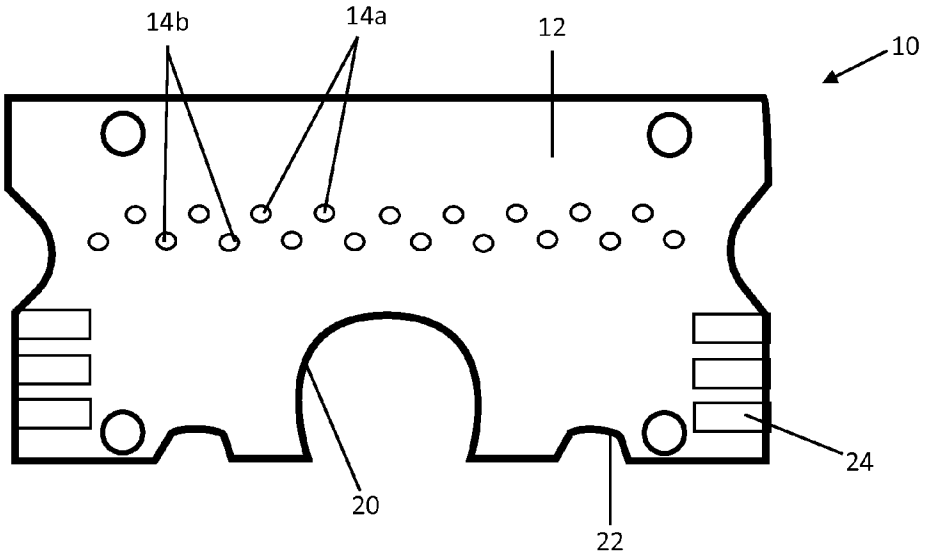
FIG. 2 is a front view of an embodiment of the device.
Figure 3:
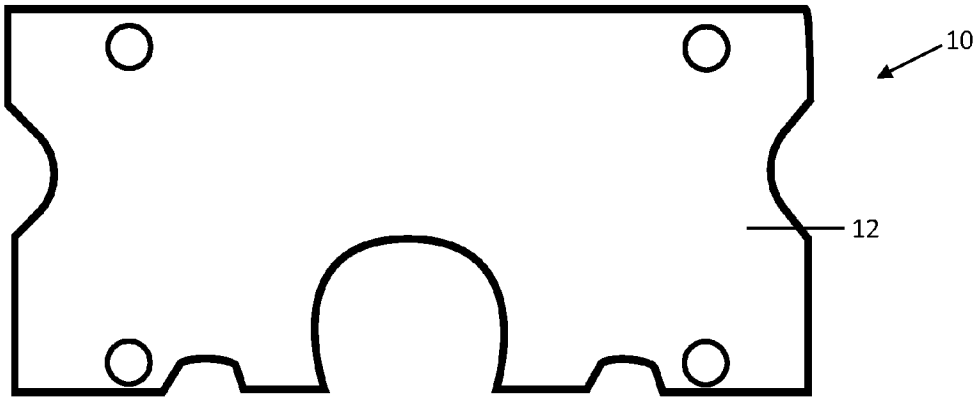
FIG. 3 is a back view of an embodiment of the device.

FIGS. 2 and 3, respectively, show front and back views of the fire containment and suppression device 10, which comprises a wall 12. The fire containment and suppression device is made using fire-resistant materials. Exemplary fire resistant materials can include concrete, galvanized steel, stainless steel, and/or lightweight materials such as high gauge aluminum or titanium. Lightweight materials can be employed to, inter alia, make the device 10 more portable to facilitate transporting. In other embodiments, heavier materials such as concrete can be employed, as for example with permanent installations where weight and/or insulative thickness is desirable.

Figure 1B:
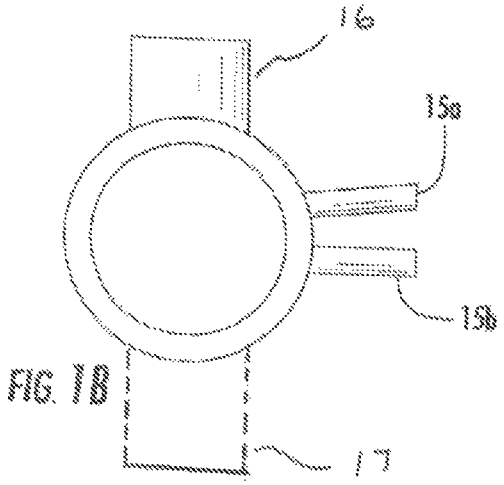
FIGS. 1B-1C are views of a pipe assembly for an embodiment of the device.
Figure 9:
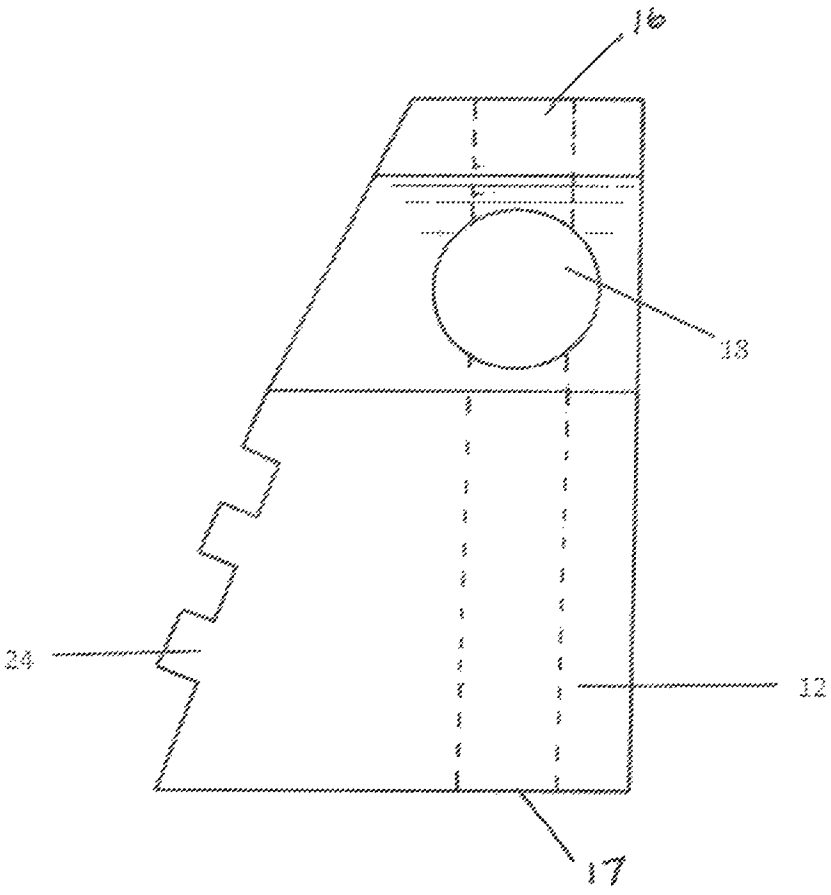
FIG. 9 is a side view of an embodiment of the device.

The device 10 comprises an inlet 16 for receiving a fire suppressant fluid. The fluid can be supplied via either permanent pipelines or portable supplies, such as water tanker vehicles. In an embodiment, the suppressant fluid may be introduced to a wall 12 via an inlet 16 and/or a wall 12 connector, although as will be appreciated, the inlet 16 can be placed anywhere that provides for a practical fluid inlet. For example, as shown in FIGS. 1A, 1B and 1C, 4, 5-6, and 9, the inlet 16 can be located at the top of the wall 12. Alternatively or in addition, an inlet 17 as shown in FIGS. 1B and 9 can also be located at the bottom of the wall 12, such as for connection to a permanent ground pipeline.

Figure 1C:
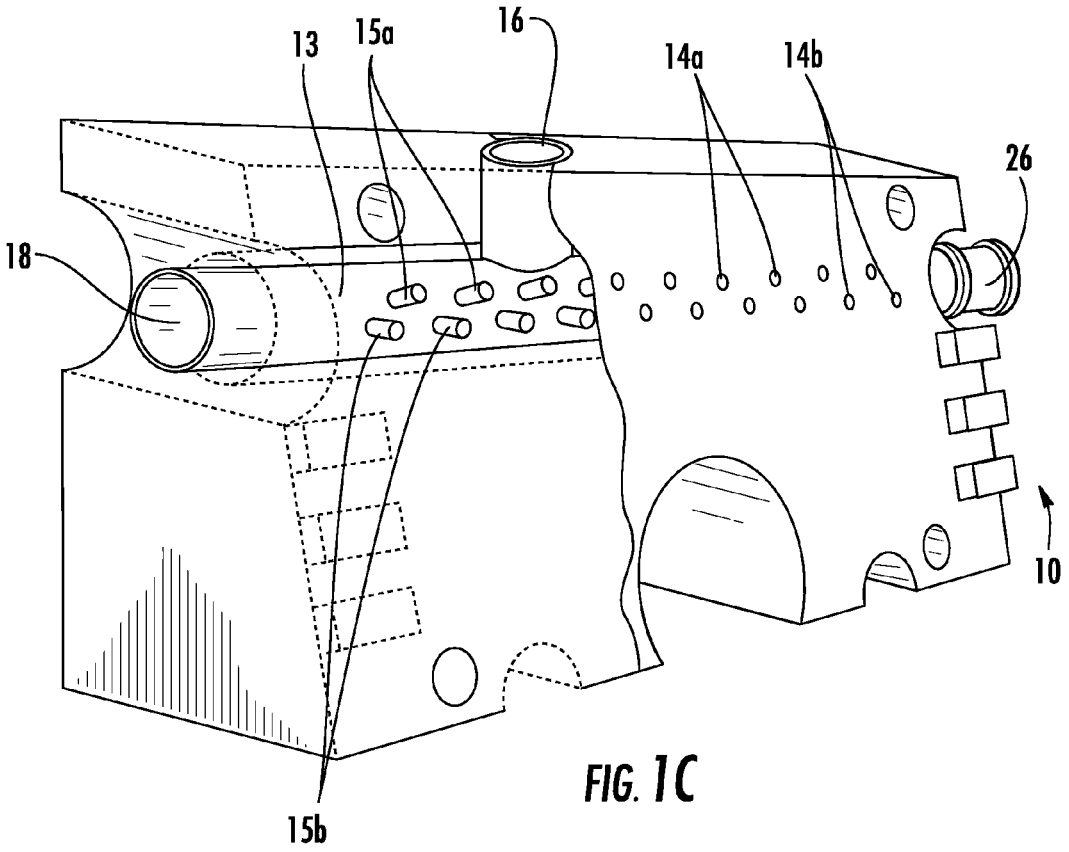

In an embodiment, the device 10 comprises a chamber 18. The chamber can be configured to receive, hold, and/or dispense the fluid. For example, once fluid enters the wall 12 through inlet 16, it can be received in a chamber 18 that extends the length of the wall 12, and then the fluid can be dispensed through dispenser 32. In an embodiment the chamber 18 can include an internal assembly, a pipe assembly for example, comprising a main artery 13 extending lengthwise through the wall and connected to one or more crosswise channels 15 extending from the main artery and ending one or more corresponding apertures 14 on a face of the wall 12. The chamber 18 can be filled with fluid under sufficient pressure to force the fluid through the apertures 14 to a desired distance. As shown in FIGS. 1A-1C, 2, 6, and 7A, the dispenser 32 of the wall 12 can comprise the plurality of staggered apertures 14. As shown in FIGS. 1B-1C, in an embodiment the channels 15 can be formed by a plurality upwardly angled pipes 15*a* connecting the main artery 13 to an upper row of apertures 14*a* and a plurality of pipes 14*b* extending at right angles from the main artery 13 and connecting it to a lower row of apertures 14*b*. The apertures 14 provide fluid dispersion over a wide area. Other dispensing configurations can be used, for example, an aperture formed as a lateral slot or slots, pipes extending out from the wall 12, or any other configuration effective to dispense the fluid.

In an embodiment the chamber can be configured to hold the fire suppressant fluid until such time as it is needed. For example, the dispenser 32 can be configured with a door or cap (not shown) on the aperture(s) 14, which opens to dispense the pressurized fluid. In embodiments the door or cap can be opened remotely (e.g. wirelessly), or can be triggered to open under appropriate environmental conditions, for example high temperatures indicating a fire.

In an embodiment, the wall 12 tapers from a base 11 to the apex, which can provide, for example, a larger base 11 for greater stability.

In an embodiment, the wall 12 can include an escape passage 20 for animals. In the case of a wildfire, animals may become trapped between the fire and the device 10. An escape passage 20 allows these animals to flee from approaching fire through the wall 12. Such escape passage 20 can sufficiently sized so as to not compromise the device's structural integrity or fire containment purpose, but large enough that animals may pass through.

In one embodiment, appropriate structural modifications to the wall 12 may be useful, such as to provide for drainage or structural support. For example, in an embodiment, drainage arches 22 can allow for fluid to pass underneath the wall section 12.

As shown in FIGS. 1-3 and FIGS. 6-7B the drainage arches 22 and escape passage 20 are openings extending through the wall 12 at its base 11.

Figure 6:
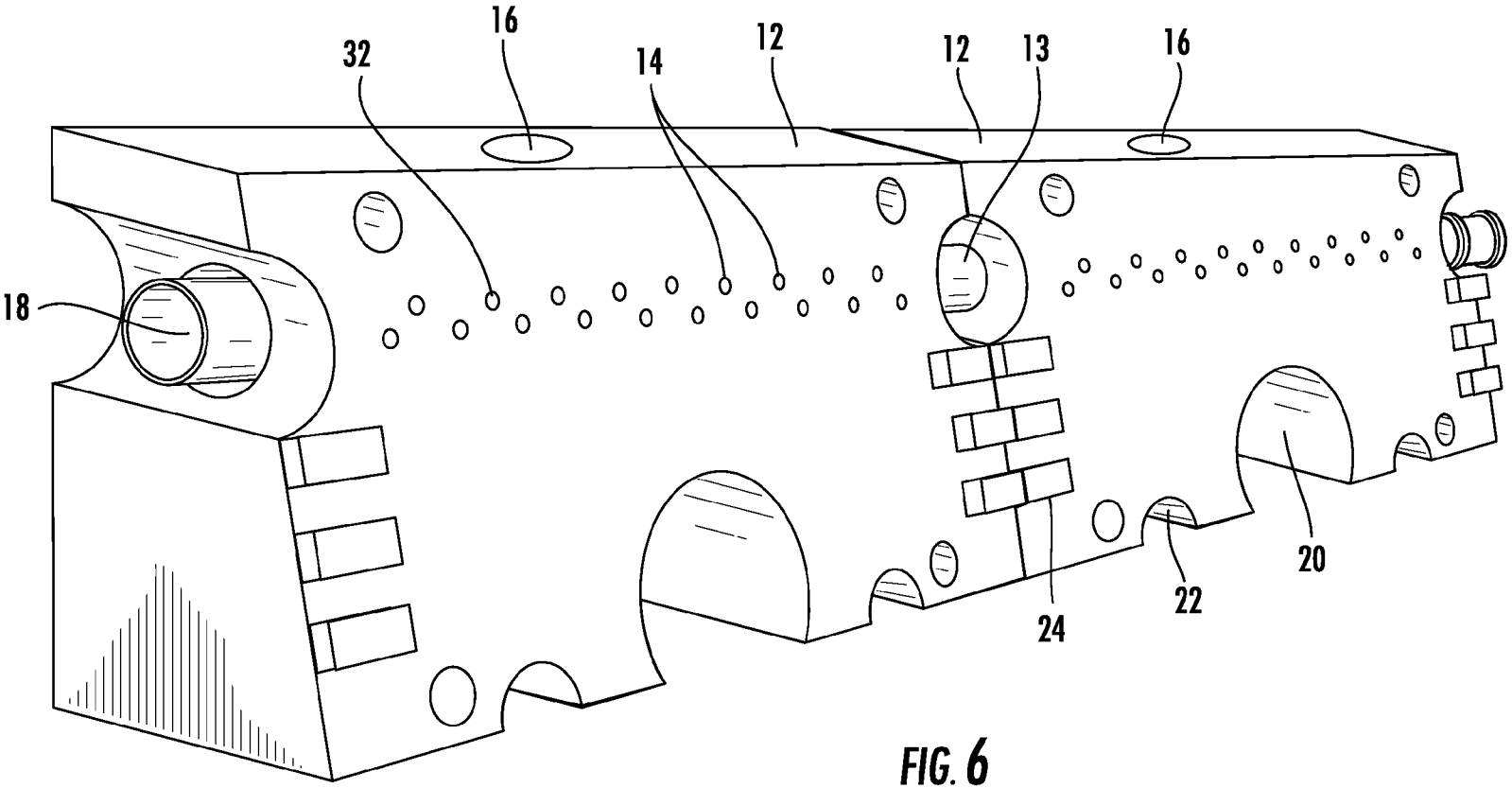
FIG. 6 is a perspective view of an embodiment of a plurality of walls.

In embodiments, the device 10 can comprise a single wall 12, or a plurality of walls 12. For example, in an embodiment, a plurality of walls 12 can be placed in series adjacent to one another in order to form a longer firewall, as shown in FIG. 6. In embodiments, walls 12 can be physically joined together.

Figure 4:
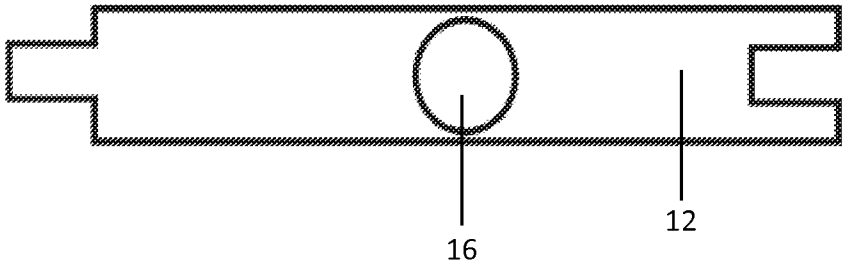
FIG. 4 is a top view of an embodiment of the device.

FIG. 4 shows a top view of a wall 12 with an inlet 16 for receiving fire suppressant fluid. In this embodiment, the wall 12 is constructed to interlock with adjacent walls using a tongue and groove method.

Figure 5:
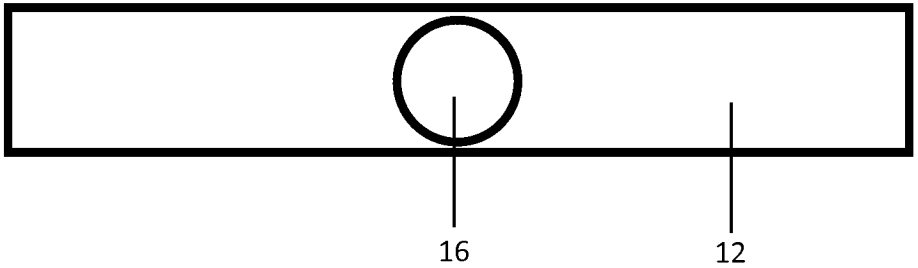
FIG. 5 is a top view of an embodiment of the device.
Figure 7A:
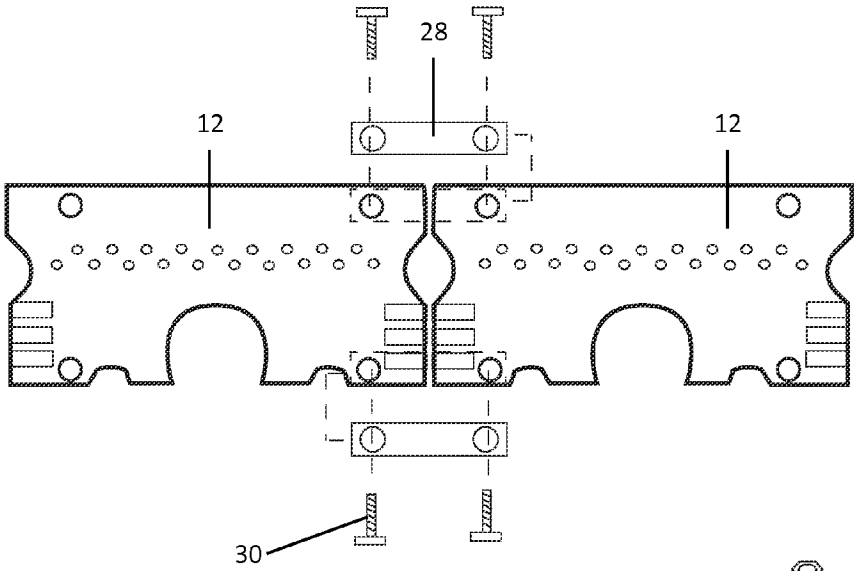
FIG. 7A is a front view of an embodiment of a plurality of walls.
Figure 7B:
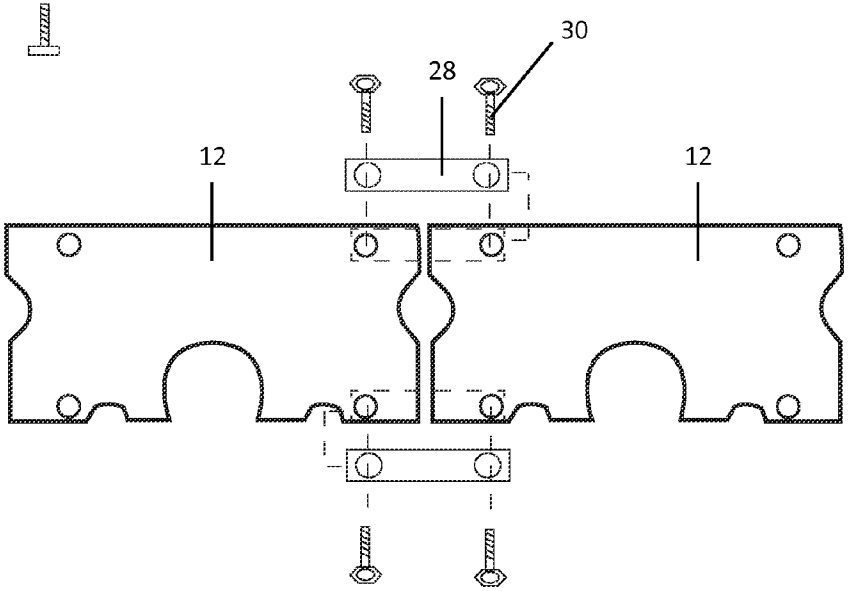
FIG. 7B is a back view of an embodiment of a plurality of walls.

FIG. 5 shows a top view of another embodiment in which the wall 12 has a rectangular configuration rather than tongue-and-groove configuration. For the embodiment shown in FIG. 5, adjacent walls 12 can be attached together using a fastener. For example, as depicted in FIGS. 7A and 7B, the fastener comprises flat plates 28 bolted between adjacent walls 12. A shown in FIG. 7A, the plates 28 can extend to and connect the front faces of adjacent walls 12. FIG. 7B shows corresponding plates 28 connecting the back faces of the walls 12. Each plate 28 is secured to the wall segment 12 at each end via a bolt 30. The embodiment shown in the figures includes plates 28 positioned at both the top and bottom of the wall segments 12, though fewer or additional plates may be used as fasteners. Other fasteners and fastening methods as known in the art and informed by this disclosure can be employed. The fasteners can include fire resistant materials as described herein, for example, metal or fireproof plates or composites.

Figure 8:
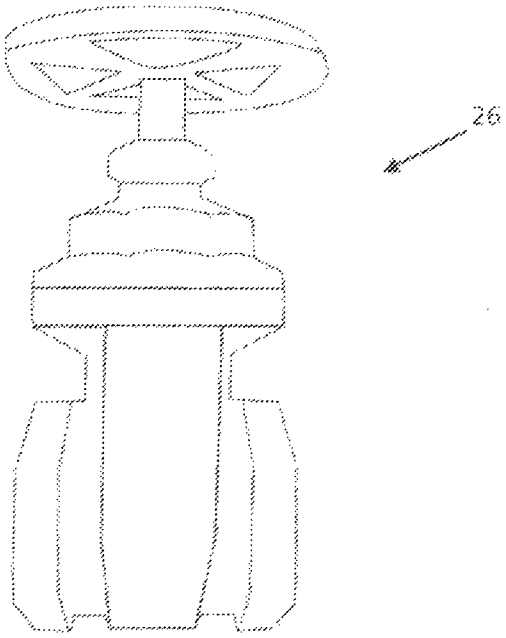
FIG. 8 is an embodiment of a connector.

In single wall embodiments, the chamber 18 can be fully self-contained within the wall, for example, constructed without end openings or capped at either end. In embodiments where a plurality of walls 12 are employed in series, the one or more chambers 18 can be configured to extend through a plurality of the walls 12 when connected. For example, each chamber 18 can be connected to the chamber 18 of an adjacent wall 12. As such, the device 10 can be configured such that a single inlet 16 can supply fluid to multiple walls 12. In embodiments, the chambers 18 can be connected via permanent connector, for example a length of straight pipe extending through a plurality of the chambers. In another embodiment, the chambers 18 can be connected via detachable connector, for example for portable walls 12. In an embodiment, as shown in FIG. 8, a connector for connecting multiple chambers 18 includes a valve 26 that can be used to regulate or shut off fluid flow between walls 12. By doing this, fluid output from a series of walls can be controlled or isolated to certain walls 12. The valves 26 can be employed to regulate fluid pressure throughout a wall series and/or to regulate flow concentration in one wall 12 over another.

In an embodiment, the chamber 18 can be a customized pipe assembly manufactured from a poured steel cast into a pour concrete mold. It can be held in place within a wall 12 by a skeletal rebar frame enclosed into the cast for pouring of the concrete.

The device 10 can be adapted for a variety of environmental conditions. For example, FIG. 9 shows a side view of an embodiment where a base of the wall 12 is wider than the top, which provides additional structural support and an aerodynamic shape. In embodiments, the device 10 comprises surface modifications, such as footholds 24 configured to, inter alia, aid firefighters and rescue workers to climb over the device 10. Other modifications can be employed, for example, to aid with transport or movement of walls 12, or to facilitate the joining of several walls.

Embodiments of the device 10 can hydrate areas of combustible vegetation by drenching the environment before the drought status escalates to dangerous levels. In addition to fire prevention, the device 10 can be used to suppress and deter fires already in existence. This can be done from a safe distance from fire in order to minimize danger to civilians as well as firefighters. The device 10 can be configured to be used alone or in tandem with conventional fire fighting methods.

The device 10 can be permanently installed in key locations, such as where there is a high probability of fires igniting, or where severe damage would occur should a fire ignite. For example, the device 10 can be installed on highways or other roadways and directed onto the landscape, or along hiking trails where the potential for forest fires exists. The device may also be used to surround commercial buildings, corporate parks, or residential areas and private homes.

The device 10 can be adapted for installation on a variety of surfaces, including steep slopes and open fields. Aesthetically, the device 10 can be modified to suit its environment, including adapting the surface for a variety of colors and textures. The height and other dimensions of the device may be varied to conform to local zoning and planning ordinances, as well as for aesthetic considerations.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Although illustrative embodiments of the invention have been described in detail herein, it is to be understood that the invention is not limited to those precise embodiments, and that various changes and modifications can be effected therein by one skilled in the art without departing from the scope and spirit of the invention.

The invention claimed is:

1. A fire prevention device comprising:

a single wall cast into a solid mass of fire resistant concrete, said wall having a length, a width and a height;

said wall having a bottom portion terminating in a bottom face and a top portion terminating in a top face, and two lateral portions, each lateral portion extending from the bottom portion to the top portion, each lateral portion terminating in one of a pair of opposite lateral faces;

a chamber cast into the substantially solid mass of fire resistant concrete wherein the top, bottom and lateral faces of the wall substantially surround and enclose the chamber, said chamber extending the length of the wall and having openings at opposite ends of the wall for allowing fire suppression fluid to pass through the chamber; and an inlet disposed at the top or bottom face of the wall and comprising a fluid passageway from outside the wall into the chamber for carrying fire suppression fluid into the chamber;

a main artery disposed inside the chamber, the main artery comprising a main pipe connected to the inlet and passing through the openings at opposite ends of the wall and extending the length of the wall;

a plurality of apertures in the face of a lateral portion of the wall, said apertures connected to the main pipe for dispensing fluid for combatting and containing forest fires.

2. The fire prevention device of claim 1 further comprising a passageway spaced from the chamber and extending through the width of the substantially solid mass of concrete along a substantially straight line between one opening in one lateral face and another opening in the opposite lateral face, said passageway surrounded on at least three sides by the substantially solid mass of concrete.

3. The fire prevention device of claim 1 wherein the wall is portable.

4. The fire prevention device of claim 1 wherein the wall comprises one or more openings in the bottom portion at the bottom face and extending from one lateral face to the other lateral face to allow drainage to pass from one side of the wall to the other.

5. The fire prevention device of claim 1 wherein the wall includes a fastener for connecting to an adjacent wall.

6. The fire prevention device of claim 1 further including footholds disposed above the base of the wall and projecting from at least one lateral face to facilitate a person's movement over the wall.

7. The fire prevention device of claim 1 comprising a plurality of the walls.

8. The fire prevention device of claim 7 wherein the walls are connected in series.

9. The fire prevention device of claim 1 wherein the fire prevention device is configured as a single wall.

10. The fire prevention device of claim 1 wherein the wall is configured to be used alone or with one or more other walls.

11. The fire prevention device of claim 1, wherein the chamber is configured to be operatively connected to a chamber of an adjacent wall such that fluid can flow through a plurality of the walls when the walls are connected.

12. The fire prevention device of claim 11, wherein the fire prevention device includes a plurality of the walls connected in series and a main artery extends through a plurality of the respective chambers of the plurality of the walls.

13. The fire prevention device of claim 11, wherein the fire prevention device includes a plurality of the walls connected in series by at least one connector connecting respective chambers for each of the plurality of walls.

14. The fire prevention device of claim 13, wherein the connector includes a valve.

15. The fire prevention device of claim 1, wherein the chamber is configured to hold the fluid under pressure.

16. The fire prevention device of claim 1 wherein the width of the wall at the bottom face is different from the width of the wall at the top face.

17. The fire prevention device of claim 1 wherein the width of the wall at the bottom face is greater than the width of the wall at the top face.

18. A fire prevention device comprising:

a wall having a length, a width and a height and comprising fire resistant material;

said wall having a bottom portion terminating in a bottom face, a top portion terminating in a top face, and two lateral portions, each lateral portion extending from the bottom portion to the top portion, each lateral portion terminating in one of a pair of opposite lateral faces;

a chamber extending the length of the wall wherein the top, bottom and lateral faces of the wall substantially surround and enclose the chamber, said chamber having openings at opposite ends of the wall for allowing fire suppression fluid to pass through the chamber;

an inlet disposed at the top or bottom face of the wall and comprising a fluid passageway from outside the wall into the chamber for carrying fire suppression fluid into the chamber;

a main artery disposed inside the chamber, the main artery comprising a main pipe connected to the inlet and passing through the openings at opposite ends of the wall and extending the length of the wall;

a plurality of apertures in the face of a lateral portion of the wall, said apertures connected to the main pipe for dispensing fluid for combating and containing forest fire; and a passageway spaced from the chamber and extending the width of the wall along a straight line from an opening in one lateral face to another opening in the other lateral face.

19. The fire prevention device of claim 18 wherein the wall is made of a refractory metal.

20. The fire prevention device of claim 19 wherein the refractory metal is titanium.

21. The fire prevention device of claim 18 wherein the wall is made of heavy gauge aluminum.

22. The fire prevention device of claim 18 wherein the wall is made of steel.

23. The fire prevention device of claim 18 wherein the wall is portable.

24. The fire prevention device of claim 18 wherein the wall comprises one or more openings in the bottom portion at the bottom face and extending from one lateral face to the other lateral face to allow drainage to pass from one side of the wall to the other.

25. The fire prevention device of claim 18 wherein the wall includes a fastener for connecting to an adjacent wall.

26. The fire prevention device of claim 18 further including footholds on at least one lateral face disposed above the base of the wall and projecting from the lateral face to facilitate a person's movement over the wall.

27. The fire prevention device of claim 18 comprising a plurality of the walls.

28. The fire prevention device of claim 27 wherein the walls are connected in series.

29. The fire prevention device of claim 18 wherein the wall is configured to be used alone or with one or more other walls.

30. The fire prevention device of claim 18, wherein the chamber is configured to be operatively connected to a chamber of an adjacent wall such that fluid can flow through a plurality of the walls when the walls are connected.

31. The fire prevention device of claim 30, wherein the fire prevention device includes a plurality of the walls connected in series and a main artery extends through a plurality of the respective chambers of the plurality of the walls.

32. The fire prevention device of claim 30, wherein the fire prevention device includes a plurality of the walls connected in series by at least one connector connecting respective chambers for each of the plurality of walls.

33. The fire prevention device of claim 32, wherein the connector includes a valve.

34. The fire prevention device of claim 18, wherein the chamber is configured to hold the fluid under pressure.

* * * * *